US009675126B2

(12) United States Patent
Allen et al.

(10) Patent No.: US 9,675,126 B2
(45) Date of Patent: Jun. 13, 2017

(54) ATHLETIC APPAREL WITH ADJUSTABLE RISE WAISTBAND

(71) Applicant: Ampac Enterprises Inc., Shirley, MA (US)

(72) Inventors: Jena Allen, Shirley, MA (US); Stan Jurga, Jr., Shirley, MA (US)

(73) Assignee: Ampac Enterprises Inc., Shirley, MA (US)

( * ) Notice: Subject to any disclaimer, the term of this patent is extended or adjusted under 35 U.S.C. 154(b) by 854 days.

(21) Appl. No.: 13/873,545

(22) Filed: Apr. 30, 2013

(65) Prior Publication Data

US 2014/0317832 A1 Oct. 30, 2014

(51) Int. Cl.

| | |
|---|---|
| ***A41D 1/06*** | (2006.01) |
| ***A41D 13/02*** | (2006.01) |
| ***A41F 9/00*** | (2006.01) |
| ***A41F 9/02*** | (2006.01) |

(52) U.S. Cl.

CPC ..... *A41F 9/025* (2013.01); *A41D 1/06* (2013.01); *A41F 9/00* (2013.01); *A41F 9/007* (2013.01)

(58) Field of Classification Search

CPC .. A41F 9/00; A41F 9/002; A41F 9/005; A41F 9/007; A41F 9/02; A41F 9/025; A41D 1/06; A41D 1/062

USPC ..... 2/79, 227, 229, 230, 236, 237

See application file for complete search history.

(56) References Cited

U.S. PATENT DOCUMENTS

| | | | | | |
|---|---|---|---|---|---|
| 1,929,296 | A * | 10/1933 | Warren | A41F 9/00 | 2/236 |
| 2,223,621 | A * | 12/1940 | Knappenberger | A41F 9/00 | 2/237 |
| 3,178,727 | A * | 4/1965 | Neinken | A41F 9/02 | 2/237 |
| 3,271,782 | A * | 9/1966 | Mallett | A41F 9/007 | 2/236 |
| 5,050,244 | A * | 9/1991 | Kleinman | A41D 1/067 | 2/227 |
| D333,203 | S * | 2/1993 | Jones | D2/738 | |
| 5,675,842 | A * | 10/1997 | Schaefer | A41F 9/02 | 2/221 |
| 6,138,282 | A * | 10/2000 | Follese | A41B 9/14 | 2/220 |
| 6,327,714 | B1 * | 12/2001 | Koerner | A41F 9/00 | 2/227 |
| 6,922,849 | B1 * | 8/2005 | Fedrick | A41D 1/062 | 2/227 |
| 7,596,816 | B1 * | 10/2009 | Henry | A41F 9/00 | 2/227 |
| 8,813,266 | B1 * | 8/2014 | Green | A41D 1/062 | 2/229 |
| 2004/0163159 | A1 * | 8/2004 | Edwards | A41F 9/02 | 2/338 |

(Continued)

*Primary Examiner* — Jameson Collier

(74) *Attorney, Agent, or Firm* — Smith, Gambrell & Russell, LLP

(57) ABSTRACT

A garment includes a waistband having a first face and a second face, with a first support structure affixed to the first face and a second support structure affixed to the second face. The waistband is selectively adjustable between a first arrangement that provides the garment with a first style and fitting, and a second arrangement that provides the garment with a same style and different fitting.

14 Claims, 8 Drawing Sheets

(56) References Cited

U.S. PATENT DOCUMENTS

| | | | | |
|---|---|---|---|---|
| 2005/0246820 | A1* | 11/2005 | Davenport | A41B 9/001 2/227 |
| 2005/0268379 | A1* | 12/2005 | MacGeorge | A41F 9/02 2/400 |
| 2010/0281601 | A1* | 11/2010 | Clarke | A41D 1/08 2/236 |
| 2011/0185470 | A1* | 8/2011 | Jones | A41D 27/20 2/69 |
| 2012/0096627 | A1* | 4/2012 | Gosse | A41D 1/082 2/227 |
| 2014/0196196 | A1* | 7/2014 | Lee | A41B 9/14 2/400 |
| 2014/0304882 | A1* | 10/2014 | Lloyd | A41F 9/00 2/69 |
| 2015/0020286 | A1* | 1/2015 | Wilson, II | A41F 9/025 2/69 |
| 2015/0196069 | A1* | 7/2015 | Burkhart | A41F 9/002 2/227 |
| 2015/0237935 | A1* | 8/2015 | Maryea | A41D 15/00 2/228 |

* cited by examiner

ATHLETIC APPAREL WITH ADJUSTABLE RISE WAISTBAND

FIELD OF THE INVENTION

The present invention relates to the field of apparel and, more particularly, athletic apparel. In particular, the present invention relates to an athletic pant, short, skirt, or the like having an adjustable rise waistband for selectively adjusting the waistline between a high-rise waistline arrangement and a low-rise waistline arrangement.

BACKGROUND OF THE INVENTION

Certain styles and fittings of clothing, though keeping in current fashion trends, may be desirable to one individual though not appealing to another. Likewise, an individual may find one style and fitting desirable for certain occasions, though consider the same style and fitting unsuitable for other occasions.

Sports clothing, and specifically women's sports clothing, is a field affected by such concerns. One concern is the style and fitting of the waistline on lower body garments designed for sports uniforms. Some women prefer the coverage and support provided by a high-rise pant, while some prefer the increased freedom of movement provided by a low-rise pant. However, sports teams often are limited to purchasing all of their sports pants in a single style and fitting, forcing some players on the team to wear pants with a style and fitting they do not like. As a result, many women flip or roll the waistband of their sports pants, either as fashion trend or as a matter of necessity in adjusting the height and/or rise of the pants to fit properly and/or comfortably.

There are problems, however, with flipping the waistband on sports pants. In particular, sports teams normally require players on the same team to have a uniform appearance (e.g., same design pattern and/or same color or pattern of colors). This often requires each player on a team to wear not only pants having a common team appearance, but also a belt having a team appearance. However, the inside of many waistbands is a bright white that does not match the outer appearance of the pants (e.g., different pattern and/or color (s), and flipping the waistband prevents the team belt from being displayed. In response to these problems, some organizations have banned flipped waistbands.

There is known in the art reversible pants having first and second sides, which may be selectively reversed by turning the pants entirely inside-out. However, reversible pants cannot remedy the foregoing problems. In particular, reversible pants provide different appearances on the two sides. As such, reversing the reversible pants will cause a different appearance that deviates from the team's uniform requirements. Flipping only the waistband will likewise result in the flipped portion of the waistband (i.e., the interior surface flipped to the exterior) having a different appearance from the exterior of the pants (i.e., the remainder of the exterior surface on the unflipped side of the pants).

Accordingly, there is a need in the art for an athletic pant, short, skirt, or the like that incorporates an adjustable rise waistband such that the wearer may selectively adjust the waistline for a high-rise waistline arrangement or a low-rise waistline arrangement. It would be desirable to provide a pant for baseball, softball, or the like that allows the wearer to choose the level of the rise of the pant without having to make permanent alterations and/or alter the standard team appearance. Moreover, such designs may be useful in other types of apparel.

SUMMARY OF THE INVENTION

The present invention provides an athletic pant with an adjustable waistband that permits adjustment in the height and/or rise of the pant. In one embodiment, the waistband includes first and second faces having, respectively, pluralities of first and second supports.

In one aspect, the plurality of first and second supports on the waistband may be of different types, permitting the use of different support devices with the pants depending on the arrangement of the waistband. In another aspect, the pluralities of first and second supports are of the same type, permitting an adjustment to the waistline while continuing to permit use of the same support device. In a further aspect, the waistband may have an identical appearance on both sides of the waistband in both the design pattern and color or color pattern of the waistband surface; and the shape, size, dimensions, and orientation of the supports affixed thereto.

In a further aspect, there may be a seam in the pant for identifying a suitable boundary along which to fold the waistband when adjusting the height and/or rise of the waistband of the pant. The seam may identify a boundary that assists in quickly folding an equal length of the waistband along the entire perimeter of the pants. If the pants include one or more pockets, the seam may identify a boundary for folding the waistband without covering the opening to the one or more pockets.

In a further aspect, the pants may have mating anchors on a hip portion and the waistband for securing the waistband in an adjusted position.

In one embodiment, the present invention relates to an athletic pant comprising a hip portion, first and second leg portions extending in a first direction from the hip portion, a waistband extending in a second direction from the hip portion and having a first face and a second face, with a plurality of first supports affixed to the first face and a plurality of second supports affixed to the second face, wherein the waistband is adjustable between a first arrangement having a first rise height and a second arrangement having a second rise height, wherein the rise height is measured from the bottom of a crotch section to a top-most end of the waistband, and wherein the second rise height is less than the first rise height, wherein the waistband is configured such that, in the first arrangement, the plurality of first supports face outward and the plurality of second supports face inward, and, in the second arrangement, the plurality of second supports face outward and the plurality of first supports face inward, and wherein the first and second supports are the same.

In this aspect of the invention, the first and second supports may comprise belt loops, suspender fasteners, drawstrings, or combinations thereof. In one embodiment, the first face comprises a first color pattern and the second face comprises a second color pattern, and wherein the first and second color patterns are substantially the same. In another embodiment, the first face comprises a first texture and the second face comprises a second texture different from the first texture.

In yet another embodiment, each of the plurality of second supports is affixed to the second face in such a manner that when the waistband is in the second arrangement, the plurality of second supports are displayed outwardly in an identical orientation as the orientation in which the plurality of first supports are displayed outwardly when the waistband is in the first arrangement. The first and second supports may have the same or different shape and/or dimensions.

In still another embodiment, the second face has an identical appearance as the first face, wherein the plurality of second supports have an identical appearance as the plurality of first supports, and wherein the waistband is configured to have an appearance in the second arrangement that is identical to an appearance of the waistband in the first arrangement, with the proviso that the waistband in the second arrangement is positioned at a height that is lower than a height at which the waistband is positioned in the first arrangement.

The athletic pant may include a seam along a perimeter of a top portion of the hip portion of the pant, wherein the seam defines a boundary along which the waistband may be folded when adjusting the waistband from the first arrangement to the second arrangement. In one embodiment, the seam may be arranged such that, when the waistband is folded along the seam, the waistband is folded an equal length along the entire perimeter of the pant. In another embodiment, the athletic pant includes at least one pocket in the hip portion, wherein the pant is configured such that, when the waistband is folded along the seam, the waistband will not cover the openings of the at least one pocket. In still another embodiment, the athletic pant includes a first anchor on the hip portion and a second anchor on the first face of the waistband, wherein the first and second anchors are adapted to engage one another to secure the waistband in the second arrangement.

The present invention is also directed to an article of clothing comprising: a waistband having a first face and a second face, with a plurality of first supports affixed to the first face and a plurality of second supports affixed to the second face, wherein the waistband is adjustable between a first arrangement having a first total height and a second arrangement having a second total height, wherein the first total height is measured from a bottom end of the article of clothing to a top end of the waistband, and with said second total height being less than said first total height, wherein the waistband is configured such that, in the first arrangement, the plurality of first supports face outward, and, in the second arrangement, the plurality of second supports faces outward, wherein the plurality of first supports and the plurality of second supports are the same.

In one embodiment, the plurality of first supports and the plurality of second supports comprise belt loops, suspender fasteners, drawstrings, or a combination thereof. For example, in one aspect, each of the plurality of first and second supports are belt loops. The article of clothing may include a first plurality of anchors on a hip portion of the article of clothing and a second plurality of anchors on the first face of the waistband, wherein the first and second pluralities of anchors are adapted to engage one another to secure the waistband in the second arrangement.

The present invention also relates to a method of manufacturing the athletic pant and/or article of clothing discussed above by affixing the plurality of first supports to the first face and affixing the plurality of second supports to the second face. In one embodiment, the method of manufacturing comprises folding a fabric layer having a front face and a rear face in a manner to press two regions of the rear face against one another; and securing the fabric layer in the folded position to thereby define the first face of the waistband on one side of the fold and the second face of the waistband on another side of the fold.

Both the foregoing general description and the following detailed description are exemplary and explanatory only and provide an explanation of the invention as claimed. The accompanying drawings are incorporated in and constitute part of this specification, and are included to provide a further understanding of the invention; to illustrate several embodiments of the invention; and, with the description, explain the principles of the invention.

BRIEF DESCRIPTION OF THE DRAWINGS

Further features and advantages of the invention may be ascertained from the following detailed description in connection with the drawings described below:

FIG. 1A illustrates the pants in a high-rise arrangement and FIG. 1B illustrates the pants in a low-rise arrangement.

FIG. 2A illustrates the pants in a high-rise arrangement, and FIG. 2B illustrates the pants in a low-rise arrangement.

FIG. 4A illustrates the waistband in a high-rise arrangement, and FIG. 4B illustrates the waistband in a low-rise arrangement.

DETAILED DESCRIPTION OF THE INVENTION

Figure 1A:
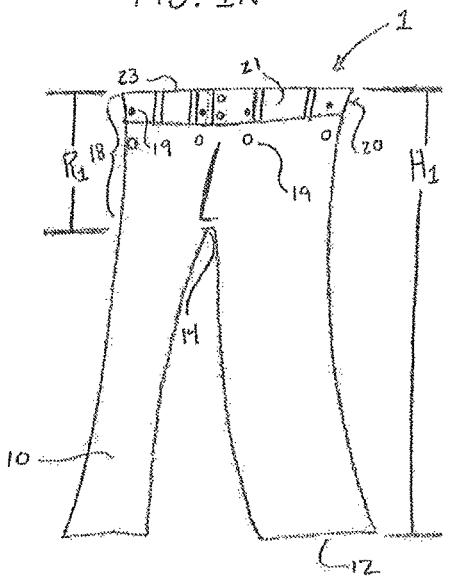
FIGS. 1A and 1B illustrate an athletic pant according to one embodiment of the present invention.

The present invention relates to an athletic pant with an adjustable rise waistband, methods of making the athletic pant, and methods of using the athletic pant. The following disclosure discusses the present invention with reference to examples in the accompanying drawings, though does not limit the invention to those examples. For example, although the following discussion addresses exemplary configurations of the novel waistband in an athletic pant, the following discussion applies equally to configurations of the waistband in lower body garments of other styles and lengths with minimal or no leg portions, such as an athletic short or skirt. In addition, while the discussion below is focused on athletic apparel, the inventors contemplate the adjustable waistband to be useful in other types of lower body garments not necessarily limited to athletic use.

In one embodiment, the athletic apparel is a pant that includes a main body with a hip portion, two leg portions extending from the hip portion, a waist portion connected to the main body of the pants at the top of the hip portion. The main body of the pant also generally includes a front portion and a rear portion. Each of the hip portion and leg portions include portions found on the front portion and back portion of the pants.

As shown in FIGS. 1A, 1B, 2A, and 2B, the athletic pant 1 may have leg portions 10, a hip portion 18, and an adjustable waistband 20. In one embodiment, the waistband 20 includes a first face 21 and a second face 22; and is adjustable between a first arrangement, where the face 21 is oriented outward and face 22 is oriented inward, and a second arrangement where face 22 is oriented outward and face 21 is oriented inward. The waistband 20 and hip portion 18 also include a plurality of mating anchors 19. In one embodiment, at least one mating anchor 19 is included on the waistband 20 and at least one mating anchor 19 is included in the hip portion 18. In another embodiment, a first plurality of mating anchors 19 are included on the waistband and a second plurality of mating anchors 19 are included in the hip portion 18. As would be understood by one of ordinary skill in the art, in this aspect of the invention, the mating anchors 19 on the adjustable waistband 20 are designed to correspond and connect to mating anchors 19 in the hip portion 18.

The number of mating anchors is not particularly limited providing the function of the anchors is accomplished, i.e., to hold the folded waistband 20 against sliding and riding-up. In one embodiment, the waistband 20 includes between 2 and 12 mating anchors and the hip portion 18 includes the same. In another embodiment, the waistband includes between 4 and 10 mating anchors.

Figure 1B:
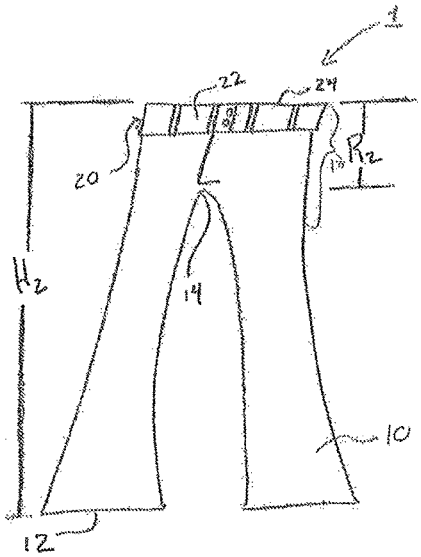
Figure 2A:
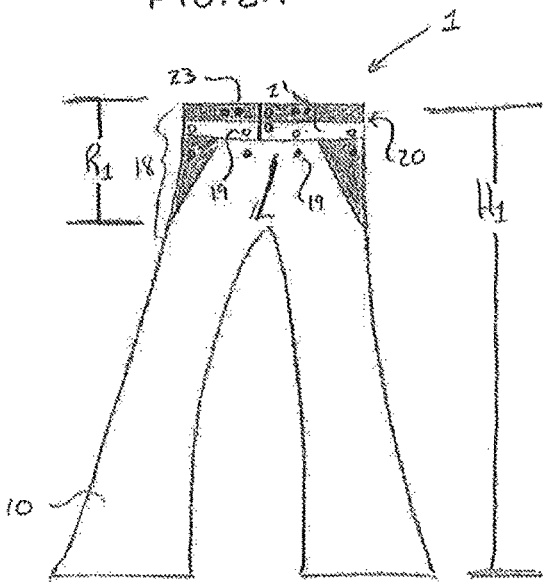
FIGS. 2A and 2B illustrate an athletic pant according to another embodiment of the present invention.
Figure 2B:
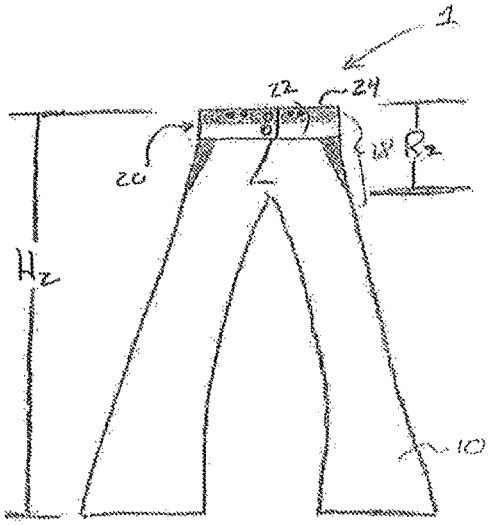

In the first arrangement, as shown in FIGS. 1A and 2A, the pants 1 have a total height H1 (measured between an end 12 of a leg 10 and an unfolded top 23 of the waistband 20), and a rise height R1 (measured from the bottom of the crotch 14 to the unfolded top 23 of the waistband 20). In the second arrangement, as shown in FIGS. 1B and 2B, the same pants 1 have a total height H2 (measured between the end 12 of the leg 10 and a folded top 24 of the waistband 20), and a rise height R2 (measured from the crotch 14 to the folded top 24 of the waistband 20).

As illustrated in FIGS. 1A-B and 2A-B, the total height H2 is less than the total height H1 and the rise height R2 is less than the rise height R1. In one embodiment, the R2 is at least about 60 percent of R1. In another embodiment, R2 is at least about 70 percent of R1. In still another embodiment, R2 is at least about 75 percent of R1. Similarly, H1 is at least about 5 percent greater than H2. In one embodiment, H1 is at least about 10 percent greater than H2. In another embodiment, H1 is at least about 12 percent greater than H2. In this manner, the waistband 20 may be said to render the pants 1 adjustable between a high-rise arrangement, with face 21 oriented outward and rise height R1, and a low-rise arrangement, with face 22 oriented outward and a rise height R2.

The ratio of R1 to H1 and R2 to H2 may alter depending on the high-rise arrangement and low-rise arrangement. In one embodiment, R1:H1 is greater than R2:H2 by at least about 10 percent. In another embodiment, R1:H1 is greater than R2:H2 by at least about 20 percent. In still another embodiment R1:H1 is greater than R2:H2 by at least about 30 percent.

Figure 3:
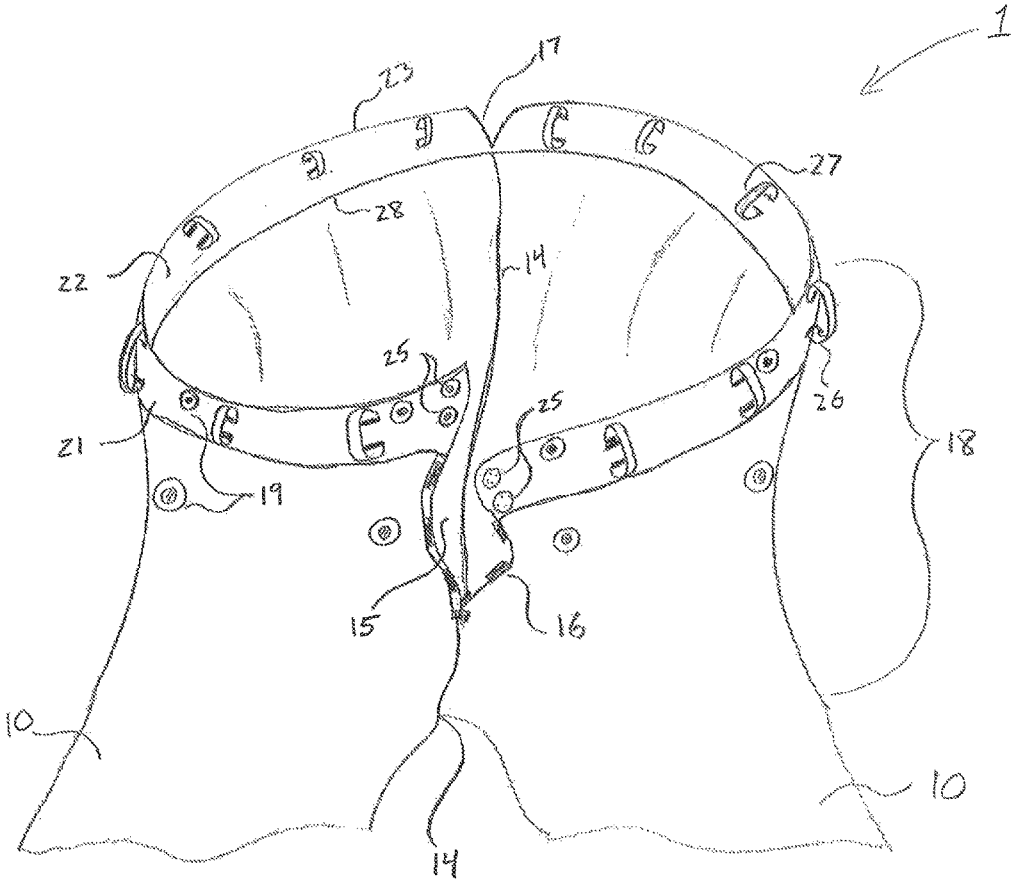
FIG. 3 illustrates a perspective view of a hip portion of a pair of pants with an adjustable waistband.
Figure 4A:
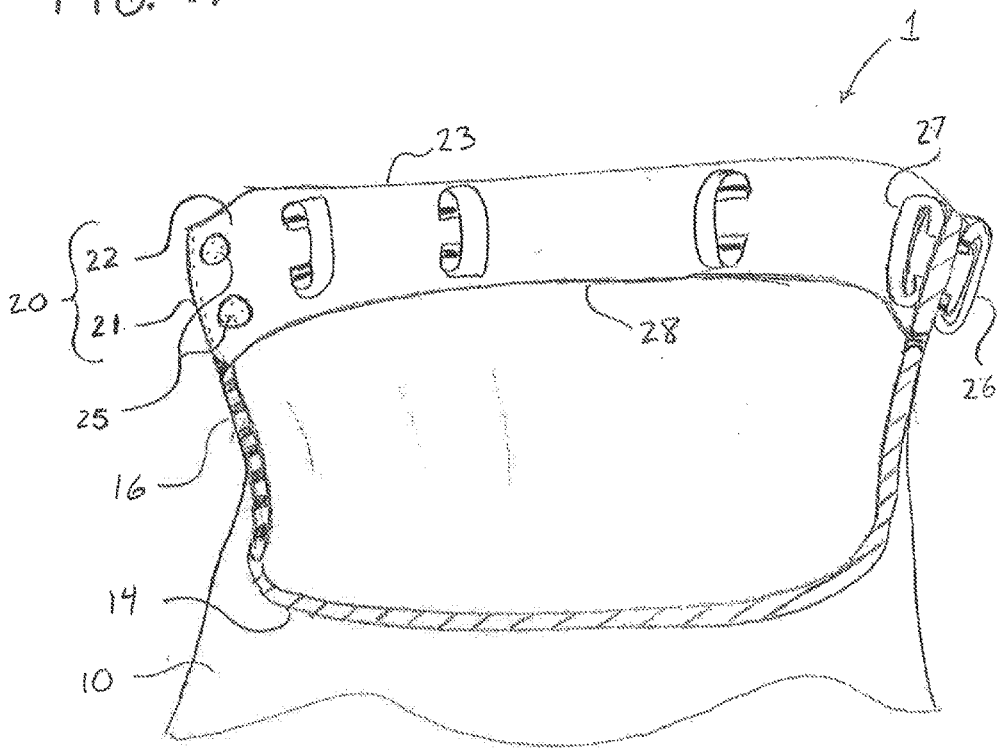
FIGS. 4A and 4B illustrate cross-sectional views of a waistband according to the present invention.
Figure 4B:
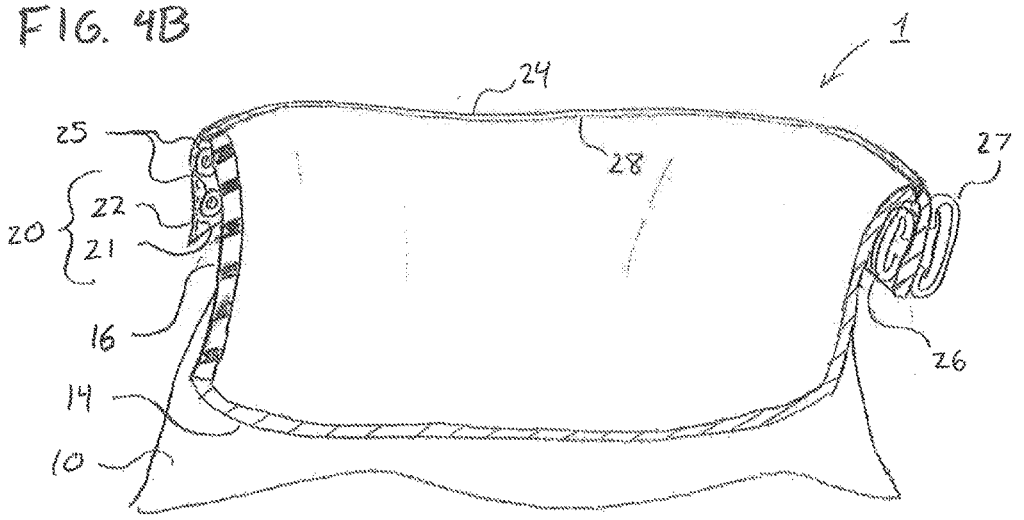

FIGS. 3 and 4A-B illustrate another embodiment of the present invention. In this example, the pants 1 include a pair of leg portions 10, a hip portion 18, and the waistband 20. The hip portion 18 include a first fastener 16 for closing a fly 15, and at least one mating anchor 19 that engages with at least one corresponding mating anchor 19 on the waistband 20. The waistband 20 includes at least one second fastener 25, at least one mating anchor 19, a plurality of first supports 26 on the first face 21, and a plurality of second supports 27 on the second face 22.

The number of first and second supports 26 and 27 is not particularly limited. In one embodiment, the waistband includes between 4 and 12 first supports. In another embodiment, the waistband includes between 6 and 10 supports. The same or similar number of second supports is contemplated.

The first and second supports 26 and 27 may be affixed to face 21 and face 22 of waistband 20 in any suitable manner that allows suitable support for a belt or similar device to be threaded therethrough. A seam 28 may define a lower edge of the waistband 20 and identify a suitable boundary for folding the waistband 20 when adjusting from a high-rise arrangement to a low-rise arrangement. The waistband 20 may also include a vent 17 to facilitate folding the waistband 20 between a high-rise arrangement and a low rise arrangement. When the pants 1 are in a low-rise arrangement, as illustrated in FIG. 4B, the mating anchors 19 (not shown) may be engaged to hold the folded waistband 20 against sliding and riding-up, and the seam 28 then represents a folded top 24 of the pants 1.

While the embodiments shown in FIGS. 1A-3 include mating anchors separate from the first supports 26, it is contemplated that the mating anchors 19 on the waistband may be associated with the first supports 26. For example, a plurality of mating anchors 19 may be present on each first support 26 and operatively connect to a plurality of mating anchors 19 in the hip portion 18.

Suitable structures for use as the first and second fasteners 16 and 25 may include a zipper, an arrangement of mating buttons and button holes, an arrangement of mating snap-fasteners, an arrangement of mating hooks-and-loops (e.g., Velcro®), an arrangement of hooks and eyes, and equivalents of the foregoing. In one aspect, the second fastener 25 of the waistband 20 may differ from the first fastener 16 of the pants 1. For example, as shown in FIGS. 3 and 4A-B, the pants 1 may include a zipper 16 while the waistband 20 may include an arrangement of mating snap-fasteners 25. In another aspect, the second fastener 25 may be the same as the first fastener 16. For example, matching arrangements of snap-fasteners may be as both the first fastener 16 and the second fastener 25. In a further aspect, the second fastener 25 may be a continuation of the first fastener 16. For example, a single zipper or a single pair of mating hooks-and-loops strips may be used in place of both the first and second fasteners 16 and 25.

Suitable mating anchors include the same structures listed above for use as fasteners, but are not limited to such structures. In one embodiment, suitable structures for use as the mating anchors may include an arrangement of mating buttons and button holes, an arrangement of mating snap-fasteners, an arrangement of mating hooks-and-loops (e.g., Velcro®), and equivalents of the foregoing. If wishing to minimize the visual presence of the anchors, the structure may be incorporated into the appearance of the pants 1 (e.g., as part of the design or color pattern), or constructed with a minimal profile.

Suitable first and second supports may include belt loops, suspender fasteners, drawstrings, and equivalents of the foregoing. In one aspect, the first support 26 affixed to the face 21 may differ from the second support 27 affixed to the face 22. For example, the face 21 may have belt loops while the face 22 may have a drawstring. In such an instance, when the waistband 20 is in a high-rise arrangement a user may support the pants 1 with a belt received in the belt loops; and when the waistband 20 is in a low-rise arrangement the user may support the pants 1 with the drawstring.

Figure 5A:
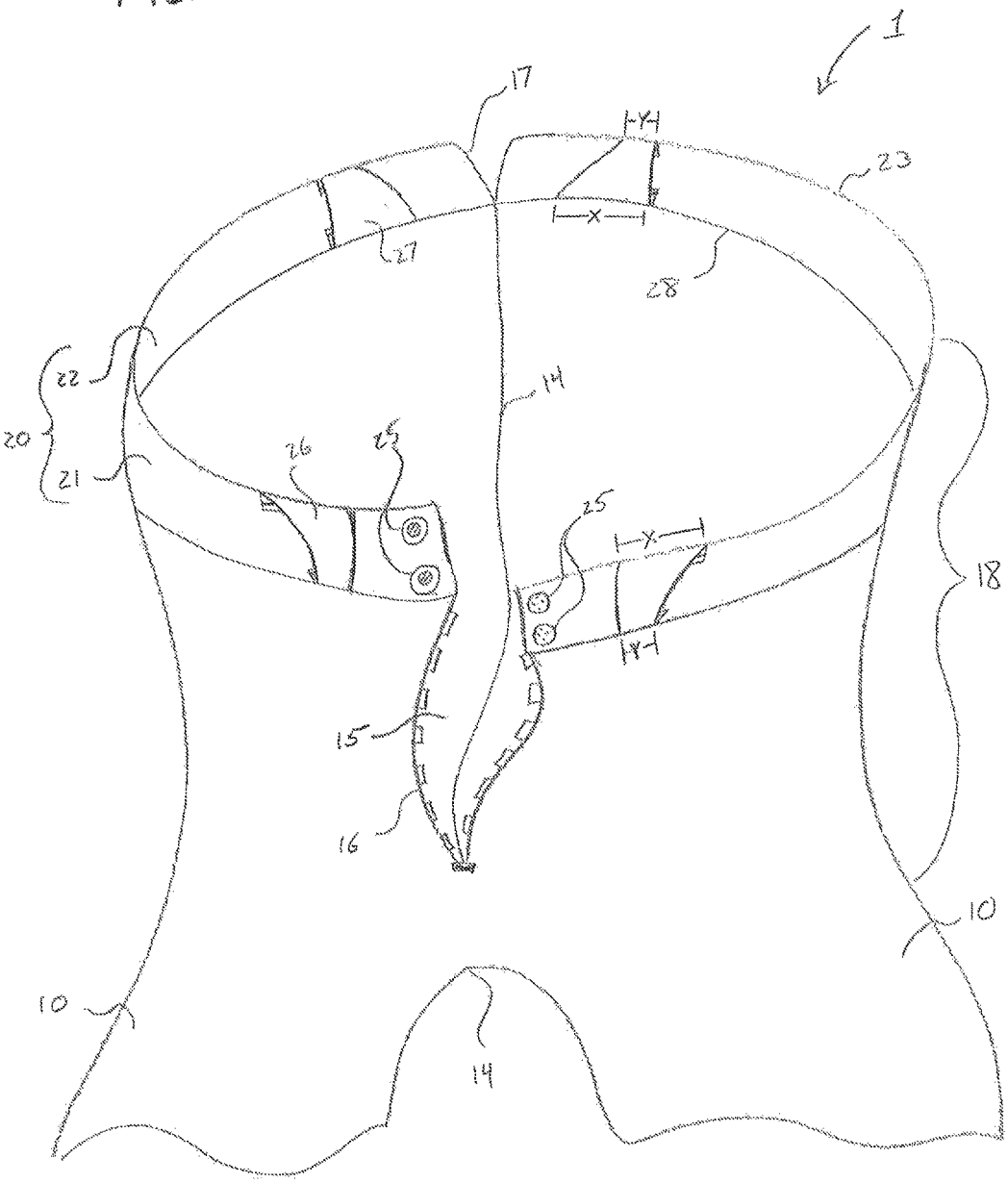
FIGS. 5A-5C illustrate perspective views of a hip portion of a pair of pants with an adjustable waistband having belt loops that provide an identical appearance in both a high-rise arrangement and a low-rise arrangement.
Figure 5B:
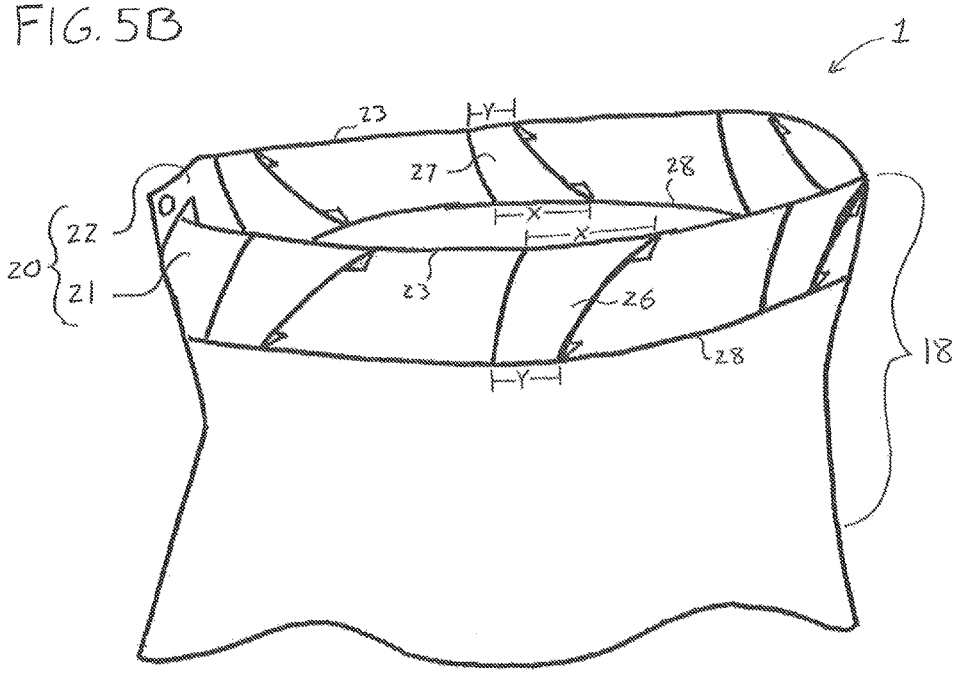
Figure 5C:
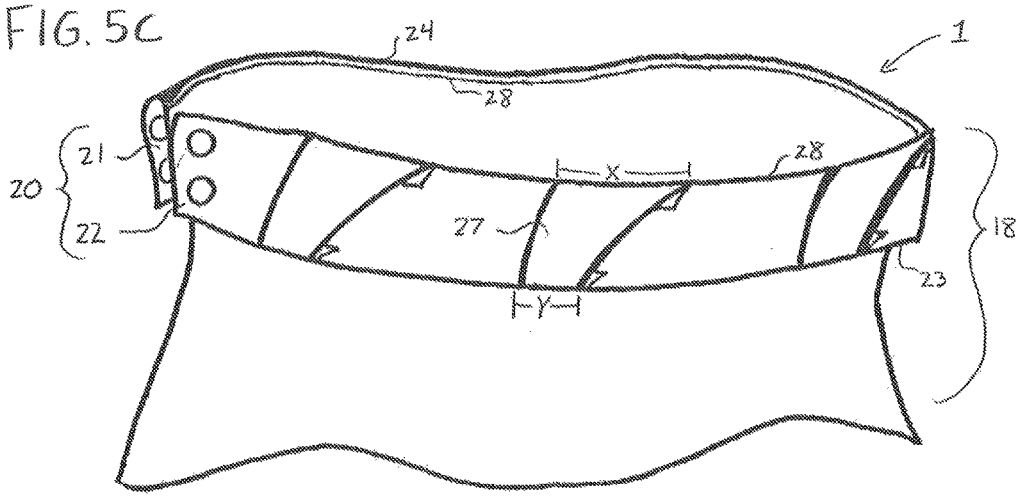
Figure 6A:
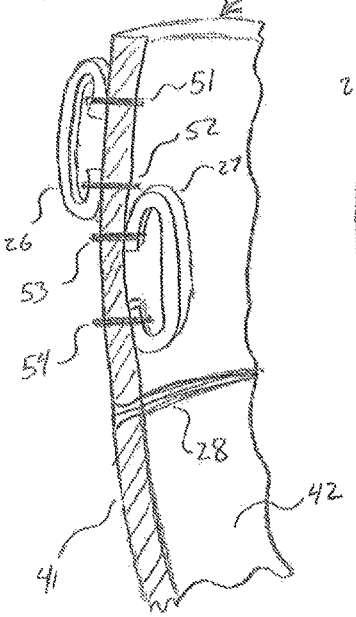
FIGS. 6A and 6B illustrate a method of manufacturing an adjustable waistband.
Figure 7A:
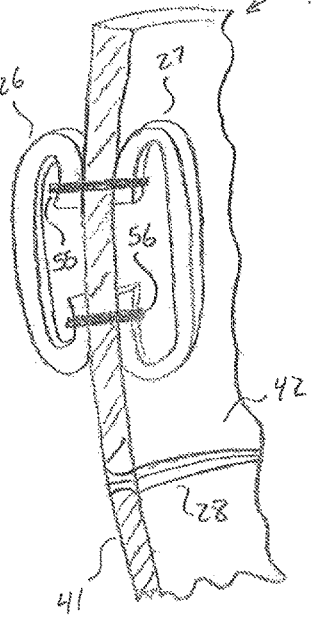
FIGS. 7A and 7B illustrate a method of manufacturing an adjustable waistband.
Figure 6B:
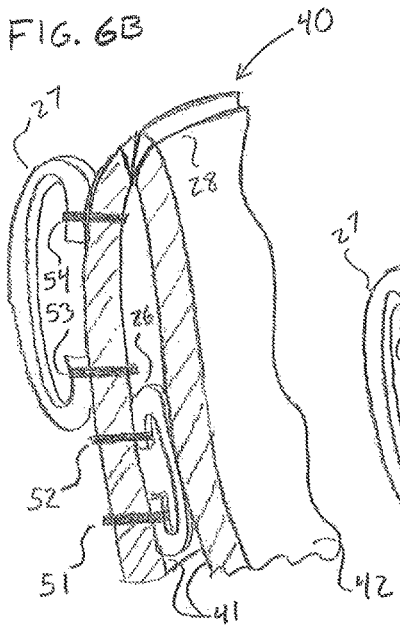
Figure 7B:
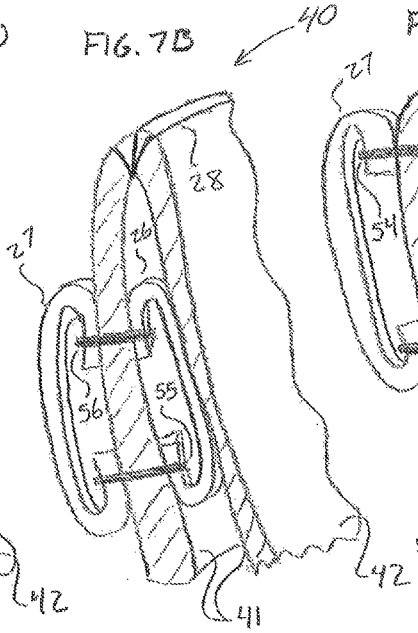

In another aspect, the first support 26 affixed to the face 21 may be the same as the second support 27 affixed to the face 22. For example, as shown in FIGS. 3, 4A-B, and 5A-C both the face 21 and the face 22 may have belt loops affixed thereto. Furthermore, the first and second supports 26 and 27 may not only be the same, but may be identical to one another in shape, size, dimensions, and overall appearance. For example, as shown in FIGS. 5A-C, the belt loops 27 on the face 22 are identical in shape and size to the belt loops 26 on the face 1, though the belt loops 27 have an inverted orientation relative to the belt loops 26. In particular, the belt loops 26 on the face 21 have a longer length "x" along the top 23 and a shorter length "y" along the seam 28, while the belt loops 27 on the face 22 have the longer length "x" along the seam 28 and the shorter length "y" along the top 23. With this configuration, when the waistband 20 is in a low-rise arrangement, the belt loops 27 will display an orientation identical to the orientation displayed by the belt loops 26 when in a high-rise arrangement—with the longer length "x" positioned above and the shorter length "y" positioned below. In this manner, the pants 1 will present an identical waistband appearance in both the high-rise arrangement (displaying belt loops 26, when not flipped) and the low-rise arrangement (displaying belt loops 27, when flipped). In addition, the face 22 and second support 27 may both have identical appearance, respectively, as the face 21 and first support 26—thereby achieving an identical appearance between the high-rise and low-rise arrangements.

A configuration such as that shown in FIGS. 3-5C, where the face 22 and second support 27 are identical, respectively, to the face 21 and the first support 26, is preferable when the pants 1 are part of a uniform. In particular, by constructing the pants 1 with a waistband 20 having an identical appearance in a high-rise arrangement and a low-rise arrangement, a player may selectively customize the rise and fitting of their pants 1 while continuing to conform to the team's uniform appearance.

The seam 28 identifies as suitable boundary for folding the waistband 20 when adjusting the pants 1 for a low-rise arrangement. In particular, the seam 28 may facilitate a user in folding the waistband 20 both quickly and in an even fashion (e.g., folding down an even length of the waistband along the entire perimeter of the pants). If the pants 1 include pockets then the seam 28 may identify a suitable boundary for folding the waistband 20 down without covering the pocket openings. If the pants are part of a uniform, the seam 28 may identify a boundary for folding the waistband 20 suitable for conforming to the team's uniform appearance. For example, as shown in FIGS. 2A and 2B, if the waistband 20 has a two-tone coloring design on the faces 21 and 22 then the seam 28 may identify a boundary for folding the waistband 20 down a sufficient length to properly display the two-tone design on the low-rise face 22.

As briefly discussed above, the present invention also contemplates the adjustable waistband described above in other lower body garments, both for athletic use and non-athletic use, including garments having full-length leg portions (e.g., "pants"), garments having short-length leg portions (e.g., "shorts"), garments having intermediate-length leg portions (e.g., cropped pants, ¾ pants, etc.), and garments with no leg portions, such as skirts.

Methods of Manufacture

In one aspect, the pants 1 may be formed from a stretchable fabric comprising an elastic material such as a nylon and spandex blend; or a nylon, polyester and spandex blend. This stretchable fabric may further include materials that provide one or more additional characteristics such as increased shock absorption, moisture management, insulation, and/or breathability. For example, the stretchable fabric may be a blended fabric comprising one or more fabrics such as those described in U.S. Pat. Nos. 6,243,879; 6,845,638; 7,682,994; and 6,432,504, the entire disclosures of which are incorporated by reference herein. Such stretchable fabrics preferably have a denier between about 1 and 150. In a further aspect, such as when the pants 1 are casual or formal pants, the pants 1 may be formed from fabrics such as denim, duck cloth, cotton, corduroy, velveteen, linen, wool, canvas, and blends of the foregoing materials. In one embodiment, the fabric used for the pants preferably have a denier between about 50 and 300. In another embodiment, fabric used for pants have a weight that ranges from about 100 to 400 grams per square meter. In yet another embodiment, the weight of the fabric for the pants may range from about 150 to 350 grams per square meter. In still another embodiment, the weight of the pants fabric ranges from about 200 to 300 grams per square meter.

The waistband 20 and the leg portions 10 may be constructed of the same or different materials. For example, in a pair of athletic pants, the leg portions 10 may be constructed of an elastic fabric blend specially adapted for increased moisture management and insulation while the hip portion of the pants, including the waistband 20, is constructed of an elastic fabric blend specially adapted for increased shock absorption and breathability. In another embodiment, face 21 of the waistband 20 is made of a first material and face 22 is made of a second material. For example, face 21 may be made of the same material as some or all of the pants 1 and/or crotch area (if not pants) and face 22 may be made of a different material that has a substantially similar look but different texture. In this aspect, face 22 may be made of an elastic material and face 21 may be made of a conventional athletic pant or skirt fabric, e.g., nylon and spandex blend; or a nylon, polyester and spandex blend. As another example, in a pair of casual pants, both the leg portions 10 and the face 21 of the waistband 20 may be constructed of denim and face 22 may be constructed of denim or may be made of a different material that has substantially the same appearance, but a different texture.

In yet another embodiment, faces 21 and 22 of the waistband 20 may be made of the same material. In this aspect, the material used to form the main portion of the pant, short, or skirt may extend up past the seam 28 over top 23 and back to seam 28 on face 22. An elastic insert or similar may be disposed between face 21 and face 22 to provide increased elasticity. As another example, in a casual skirt, both the main skirt portion and faces 21 and 22 of the waistband 20 may be constructed of the same material with a pliable medium, such as elastic disposed between faces 21 and 22.

Figure 8A:
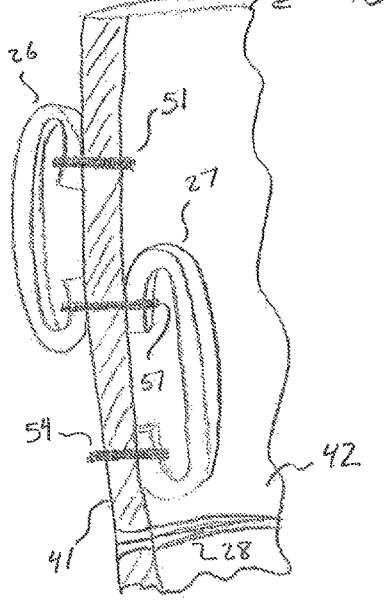
FIGS. 8A and 8B illustrate a method of manufacturing an adjustable waistband.
Figure 8B:
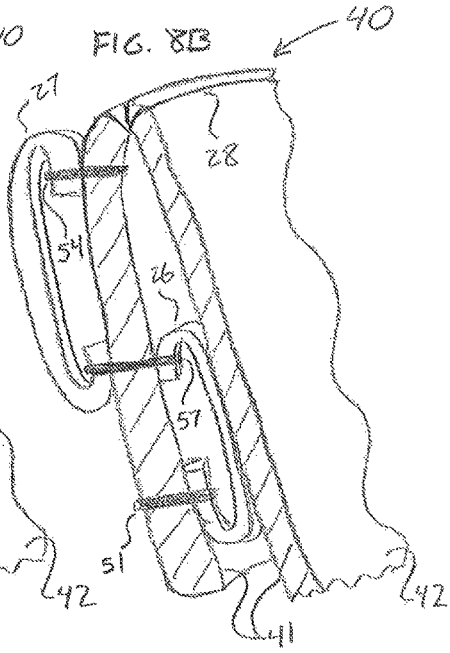
Figure 9A:
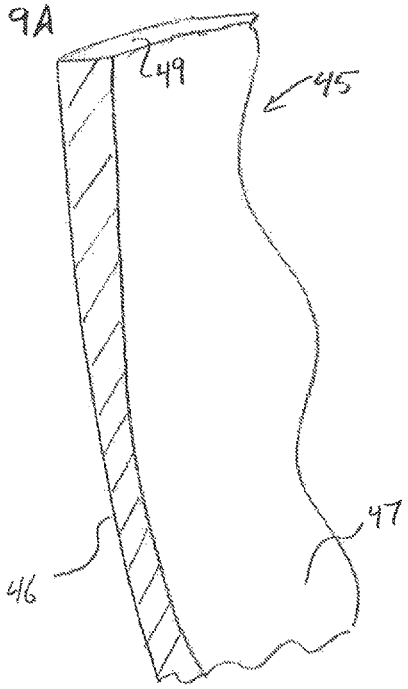
FIGS. 9A-9D illustrate a method of manufacturing an adjustable waistband.
Figure 9B:
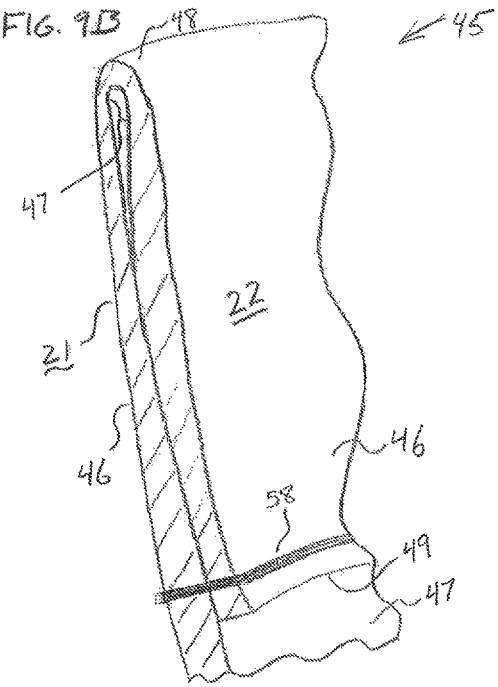
Figure 9C:
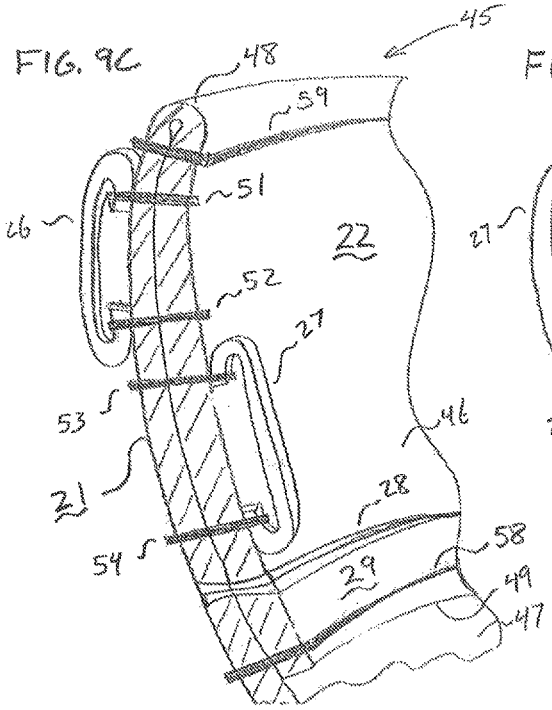
Figure 9D:
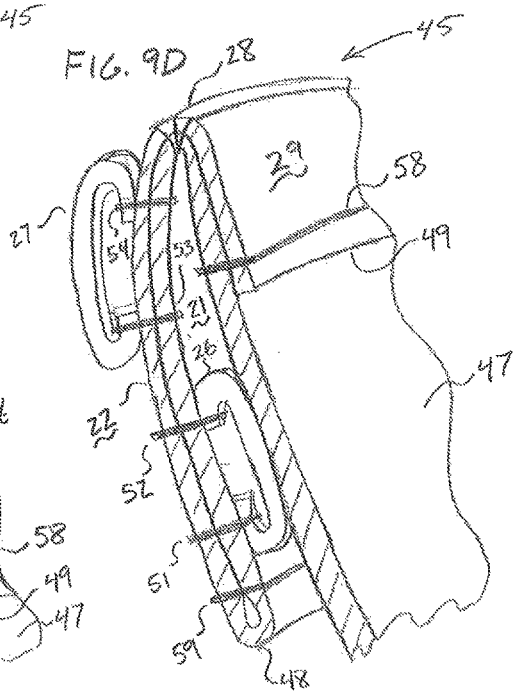
Figure 10A:
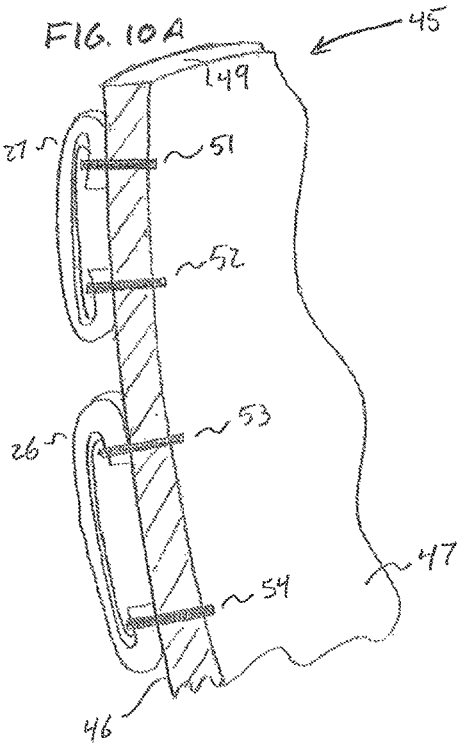
FIGS. 10A-10D illustrate a method of manufacturing an adjustable waistband.
Figure 10B:
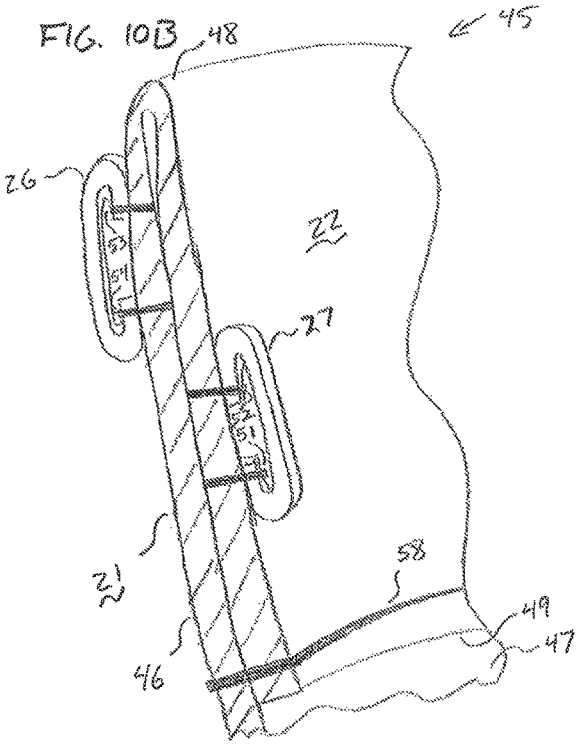
Figure 10C:
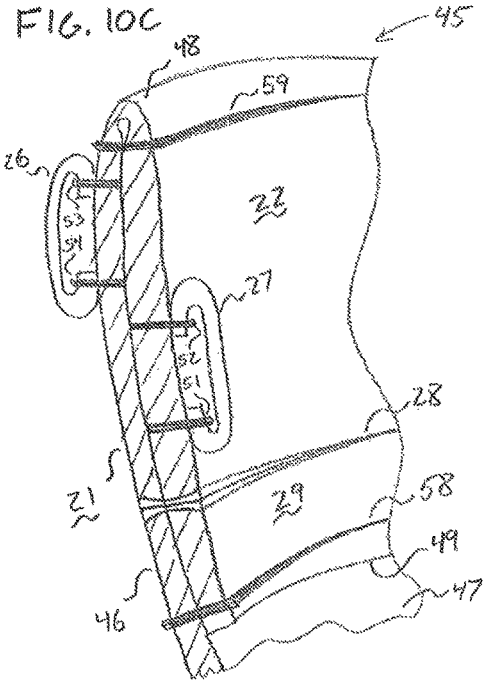
Figure 10D:
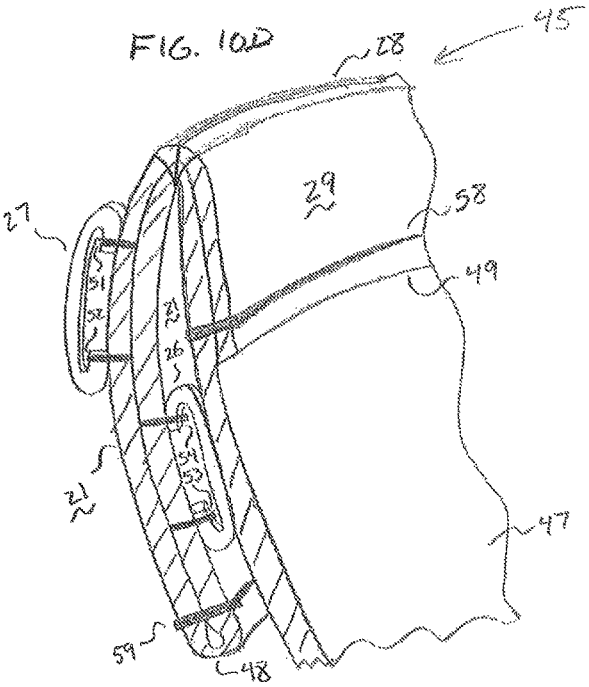

If the pants 1 are produced with a fabric 40 having a front surface 41 and a rear surface 42 identical in appearance, then the waistband 20 may be constructed in a manner as shown in FIGS. 6A-8B. In particular, once a suitable location for the waistband 20 is identified, a first support 26 may be affixed to the front face 41 and a second support 27 may be affixed to the rear face 42. In the example shown in FIGS. 6A-B the first and second supports 26 and 27 are affixed by stitching 51, 52, 53, and 54. In an alternative example, when the first and second supports 26 and 27 are affixed at opposing positions on the front and rear surfaces 41 and 42, as shown in FIGS. 7A-B, the first and second supports 26 and 27 may be affixed by shared stitching 55 and 56. In another example, if only one end of each first and second supports 26 and 27 are positioned opposite one another, as shown in FIGS. 8A-B, then a shared stitching 57 may affix the opposing ends while separate stitching 51 and 54 are used to affix the two remaining ends of the respective fasteners.

The seam 28 may be formed at a location in the fabric 40 to identify a suitable boundary for adjusting the waistband 20 to a low-rise arrangement. In particular, the seam 28 is positioned a sufficient length below the second support 27 (when in a high-rise arrangement) such that when the waistband 20 is folded at the seam 28 the second support 27 will be positioned at a suitable location for supporting the pants 1 in a low-rise arrangement (e.g., by receiving a belt, engaging suspenders, etc.). If mating anchors 19 are provided on the hip portion 18 and the waistband 20, then the seam 28 may identify a suitable boundary for folding the waistband 20 to bring the mating anchors 19 into engagement with one another.

If the pants 1 are formed from a fabric 45 having a front surface 46 and rear surface 47 that differ in appearance, then the waistband 20 may be constructed in a manner as shown in FIGS. 9A-9D. In particular, once a suitable location for the waistband 20 is identified, the fabric 45 may be folded to press two regions of the rear surface 47 against one another and a stitching 58 is made to secure the pants 1 in the folded position and define a fold 48. In this manner, there is defined a first face 21 and a second face 22 on opposite sides of the fold 48, with the faces 21 and 22 having identical appearances. An additional stitch 59 may be made proximate to the fold 48 to provide a finished appearance. After securing the fabric 45 in a folded position, a first support 26 is affixed to the face 21 and a second support 27 is affixed to the face 22. In this example, a seam 28 may be made at a location between the second support 27 and the stitch 58, defining a surface region 29 between the seam 28 and the stitching 58. The seam 28 in this example may provide the same benefits as discussed in the examples of FIGS. 6A-8B. However, by forming the surface region 29 there is an additional benefit in that, when the waistband 20 is flipped down in a low-rise arrangement, the surface region 29 will span from the seam 28 to the stitching 58, which remains on the interior of the pants 1. In this manner, the surface region 29 will prevent the unfinished end 49 of the folded fabric 45 from projecting above the waistband 20, and maintain a finished appearance. Although the example in FIGS. 9A-D discloses the belt loops 26 and 27 affixed to the fabric 45 by individual stitches 51, 52, 53, and 54, one may instead affix the first and second supports 26 and 27 in this example by one or more shared stitching, similar to the examples of FIGS. 7A-B and 8A-B.

FIGS. 10A-D illustrate an alternative method for assembling pants 1 from a fabric 45 having non-identical front and rear surfaces 46 and 47. In particular, one may affix the first and second supports 26 and 27 to the front surface 46 prior to folding and stitching the fabric 45. In this manner, the stitching 51, 52, 53, and 54 need each pass through only a single layer of the fabric 45, rather than two layers of the fabric. As a result, this method may be performed with a finer grade of stitching material and/or may reduce the visual appearance of stitching on an exterior facing surface of the waistband 20.

Although the foregoing examples disclose a single fabric layer (e.g., the single unfolded layer 40 in FIGS. 6A-8B, or the single folded layer 45 in FIGS. 9A-10D), it is appreciated that one or more additional fabric layers may be added. For example, in the methods of FIGS. 6A-8B, one or more fabric layers may be affixed to the front and rear surfaces 41 and 42 of the fabric 40 prior to affixing the first and second supports 26 and 27. Similarly, in the examples of FIGS. 9A-10D, one or more fabric layers may be affixed to the rear surface 47 of the fabric layer 45 (prior to folding and stitching the fabric layer) to arrange additional fabric layers between the faces 21 and 22 of the folded layer 45. Additional fabric layers may be included in the forgoing examples to provide one or more benefits such as increased stiffness, elasticity, shape retention, and/or durability. Also, additional fabric layers may be applied to the surfaces 41 and 42 (in the examples of FIGS. 6A-8B) or to the faces 21 and 22 (in the examples of FIGS. 9A-10D) to provide the waistband 20 with faces 21 and 22 having matching appearances. For example, one or more additional layers may be added to achieve identical two-tone designs on the faces 21 and 22, as illustrated in FIGS. 2A-B.

Although the foregoing examples are discussed relative to belt loops, it is appreciated the foregoing examples are likewise applicable to configurations using other types of supports. In addition, although the foregoing examples discuss affixing the first and second supports 26 and 27 by stitching, it is appreciated that other methods of affixing the supports may be used. For example, suitable ways of affixing the supports may include stitching, gluing, riveting, and equivalents of the foregoing.

Methods of Use

In use, a user will put on the pants 1 and secure the first fastener 16. The user will then selectively adjust the waistband 20 as desired to either a high-rise arrangement, as illustrated in FIGS. 1A and 2A, or a low-rise arrangement, as illustrated in FIGS. 1B and 2B.

If the waistband 20 is made of a sufficiently elastic material, then the user may secure the first fastener 25 while the waistband 20 is in a high-rise arrangement and flip the waistband 20 to a low-rise arrangement without having to release the first fastener 25. If the waistband 20 is not made of a sufficiently elastic material, then the user may be required to secure the first fastener 25 only after adjusting the waistband 20 to a low-rise arrangement, and may likewise be required to release the first fastener 25 if adjusting from a fastened high-rise arrangement to a low-rise arrangement. The waistband 20 may include a vent 17 to facilitate folding the waistband 20.

Once the waistband 20 is positioned in a preferred arrangement (high-rise or low-rise), the user may support the pants 1 with an appropriate support device. For example, when the first and second supports 26 or 27 on the exposed face 21 or 22 of the waistband 20 are belt loops, the user may secure the pants 1 by inserting a belt through the belt loops and fastening the belt. In another example, when the exposed supports are suspender fasteners, the user may secure the pants 1 by engaging a pair of suspenders to the suspender fasteners. In a further example, when the exposed supports is a drawstring, the user may secure the pants 1 by tightening the drawstring and securing the string by tying a knot.

In one example, if the pants 1 are women's athletic sports pants, a user may wear the pants 1 in an arrangement preferred for the particular activities of the sport. In particular, if the user is playing softball and they are playing a position that requires the user to bend forward, such as a catcher or an infielder, then the user may wear the pants 1 in a high-rise arrangement to reduce exposure and increase the coverage provided by the pants 1 when bent over. Alternatively, if the user is playing a position that requires them to react and more quickly, such as an outfielder, then the user may wear the pants 1 in a low-rise arrangement to reduce movement restriction and increase agility. Furthermore, because the waistband is readily adjustable, an infielder who wears the pants 1 in a high-rise arrangement when playing the field may adjust the waistband to a low-rise arrangement when batting to facilitate swinging the bat and running the bases.

When adjusting the waistband 20 it may, or may not, be required for the user to change the support device used with the pants 1 depending on the type of first and second supports 26 and 27. For example, if the pants 1 have a high-rise face 21 with suspender fasteners 26 and a low-rise face 22 with belt loops 27, then a user may have to remove a pair of suspenders engaged to the suspender fasteners 26 and insert a belt through the belts loops 27 when adjusting from a high-rise arrangement to a low-rise arrangement. However, if the pants 1 have a high-rise face 21 with belt loops 26 and a low-rise face 22 with belt loops 27, then a user may remove a belt received in the belt loops 26 and insert the same belt through the belts loops 27 after adjusting from a high-rise arrangement to a low-rise arrangement, and vice-versa. In an example of a sports uniform, it is preferred that the first and second supports 26 and 27 be of the same type, such that the user may readily adjust the waistband 20 while continuing to the use the same, team uniform, support device. Advantageously, because the adjustment between high-rise and low-rise arrangements does not require removing the pants 1, a user may make the adjustment with no need for privacy.

Although the present invention has been described with reference to particular embodiments, it will be understood to those skilled in the art that the disclosure is exemplary only and that various other alternatives, adaptations, and modifications may be made within the scope and spirit of the present invention. For example, though the foregoing examples present configurations of the waistband in garments with leg portions, it is appreciated that the adjustable waistband may be constructed in other lower body garments that are free of leg portions, such as women's skirts. It is understood, however, that in a skirt configurations there is no measurement for rise height as there is no crotch section. Instead, the different arrangements of the adjustable waistband in a skirt configuration would achieve differences in total height, as measured from a lower end of the skirt to the upper edge of the waistband in the unfolded and folded positions.

In addition, the present invention is contemplated for numerous types of sports including, but not limited to, softball, baseball, golf, and snowboarding and skiing. The invention may also include additional features, if desired, including features that are known and used in the art.

To the extent necessary to understand or complete the disclosure of the present invention, all publications, patents, and patent applications mentioned herein are expressly incorporated by reference to the same extent as though each were individually so incorporated. In addition, ranges expressed in the disclosure are considered to include the endpoints of each range, all values in between the end points, and all intermediate ranges subsumed by the end points.

The present invention is not limited to the specific embodiments as illustrated herein, but is instead characterized by the appended claims.

What is claimed is:

1. An athletic pant comprising:

a hip portion;

first and second leg portions each extending in a first direction from the hip portion;

a waistband comprising a piece of material, said waistband extending in a second direction from the hip portion and having a first face and a second face, with a plurality of first supports affixed to the first face and a plurality of second supports affixed to the second face, wherein the waistband is adjustable between a first arrangement having a first rise height and a second arrangement having a second rise height, wherein the first rise height and the second rise height are each measured from a bottom of a crotch section of the athletic pant to a top-most end of the waistband, and wherein the second rise height is less than the first rise height, wherein the waistband is configured such that, in the first arrangement, the plurality of first supports face outward and the plurality of second supports face inward, and, in the second arrangement, the plurality of second supports face outward and the plurality of first supports face inward, wherein the plurality of second supports each comprise a same shape and same dimensions as each of the plurality of first supports and a spacing between the plurality of second supports is equal to a spacing between the plurality of first supports such that the waistband has a configuration in the second arrangement that is identical to a configuration of the waistband in the first arrangement with exception to the difference between the first rise height and the second rise height, wherein the plurality of first supports and the plurality of second supports are of a same type; and further comprising a first anchor on the hip portion and a second anchor on the first face of the waistband, wherein the first and second anchors are adapted to engage one another to secure the waistband in the second arrangement.

2. The athletic pant of claim 1, wherein the plurality of first supports and the plurality of second supports comprise belt loops, suspender fasteners, drawstrings, or combinations thereof.

3. The athletic pant of claim 1, wherein the first face comprises a first color pattern and the second face comprises a second color pattern, and wherein the first color pattern is the same as the second color pattern.

4. The athletic pant of claim 1, wherein the first face comprises a first texture and the second face comprises a second texture different from the first texture.

5. The athletic pant of claim 1, wherein each of the plurality of second supports is affixed to the second face in such a manner that when the waistband is in the second arrangement, the plurality of second supports are displayed outwardly in an identical orientation as the orientation in which the plurality of first supports are displayed outwardly when the waistband is in the first arrangement.

6. The athletic pant of claim 1, further comprising a seam along a perimeter of a top portion of the hip portion of the pant, wherein the seam defines a boundary along which the waistband may be folded when adjusting the waistband from the first arrangement to the second arrangement.

7. The athletic pant of claim 6, wherein the seam is arranged such that, when the material of the waistband is folded along the seam, the folded material of the waistband maintains a constant length along the entire perimeter of the pant.

8. A method of manufacturing the athletic pant of claim 1, comprising:

affixing the plurality of first supports to the first face; and affixing the plurality of second supports to the second face.

9. A method of manufacturing the athletic pant of claim 1, comprising:

folding a fabric layer having a front face and a rear face in a manner to press two regions of the rear face against one another; and securing the fabric layer in the folded position to thereby define the first face of the waistband on one side of the fold and the second face of the waistband on another side of the fold.

10. An article of clothing comprising:

a waistband having a first face and a second face, with a plurality of first supports affixed to the first face and a plurality of second supports affixed to the second face, wherein the waistband is adjustable between a first arrangement having a first total height and a second arrangement having a second total height, wherein the total height is measured from a bottom end of the article of clothing to a top end of the waistband, and with said second total height being less than said first total height, wherein the waistband is configured such that, in the first arrangement, the plurality of first supports face outward, and, in the second arrangement, the plurality of second supports face outward, wherein the plurality of second supports each comprise a same shape and same dimensions as each of the plurality of first supports and a spacing between the plurality of second supports is equal to a spacing between the plurality of first supports such that the waistband has a configuration in the second arrangement that is identical to a configuration of the waistband in the first arrangement with exception to the difference between the first total height and the second total height, wherein the plurality of first supports and the plurality of second supports are of a same type; and further comprising a first plurality of anchors on a hip portion of the article of clothing and a second plurality of anchors on the first face of the waistband, wherein the first and second pluralities of anchors are adapted to engage one another to secure the waistband in the second arrangement.

11. The article of clothing of claim 10, wherein the plurality of first supports and the plurality of second supports comprise belt loops, suspender fasteners, drawstrings, or a combination thereof.

12. The article of clothing of claim 11, wherein each of the plurality of first supports and the plurality of second supports are belt loops.

13. A method of manufacturing the article of clothing according to claim 10, comprising:

affixing the plurality of first supports to the first face; and affixing the plurality of second supports to the second face.

14. A method of manufacturing the article of clothing according to claim 10, comprising:

folding a fabric layer having a front face and a rear face in a manner to press two regions of the rear face against one another; and securing the fabric layer in the folded position to thereby define the first face of the waistband on one side of the fold and the second face of the waistband on another side of the fold.

* * * * *